US006843319B2

(12) United States Patent
Tran et al.

(10) Patent No.: US 6,843,319 B2
(45) Date of Patent: Jan. 18, 2005

(54) EXPANSION ASSEMBLY FOR A TUBULAR EXPANDER TOOL, AND METHOD OF TUBULAR EXPANSION

(75) Inventors: Khai Tran, Pearland, TX (US); Patrick G. Maguire, Cypress, TX (US); J. Eric Lauritzen, Kingwood, TX (US); Clayton Plucheck, Tomball, TX (US); Caswell D. Vickers, III, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/318,292

(22) Filed: Dec. 12, 2002

(65) Prior Publication Data

US 2004/0112610 A1 Jun. 17, 2004

(51) Int. Cl.[7] ..... E21B 23/00
(52) U.S. Cl. ..... 166/277; 166/384; 166/207
(58) Field of Search ..... 166/277, 384, 166/206, 207

(56) References Cited

U.S. PATENT DOCUMENTS 3,943,997 A * 3/1976 Davis ..... 166/312
6,457,532 B1 10/2002 Simpson ..... 166/380
6,695,063 B2 2/2004 Lauritzen et al.
2003/0075339 A1 * 4/2003 Gano et al. ..... 166/380
2003/0168222 A1 * 9/2003 Maguire et al. ..... 166/380

FOREIGN PATENT DOCUMENTS

SU 1745873 7/1992
WO WO 01/83932 11/2001

OTHER PUBLICATIONS

U.K. Search Report, Application No. GB 0328868.5, dated Mar. 10, 2004.

* cited by examiner

*Primary Examiner*—William Neuder
(74) *Attorney, Agent, or Firm*—Moser, Patterson & Sheridan, L.L.P.

(57) ABSTRACT

An improved expansion assembly for an expander tool is provided. The expander tool is used to expand a surrounding tubular body within a wellbore. Accordingly, a method for expanding a surrounding tubular is also provided. The expansion assembly first comprises a piston disposed within a recess of the expander tool. The top surface of the piston closely receives a pad. The pad is held in close proximity to the top surface of the piston such that it does not rotate about a shaft. This arrangement reduces the geometric size of the expansion assembly, affording a larger inner diameter for the hollow bore of the expander tool itself. At least one reinforcement member is disposed on or within the pad to strengthen the pad during an expansion operation. The reinforcement member is fabricated from a durable material, and is arranged along the pad in the area of contact with the surrounding tubular during an expansion operation.

44 Claims, 8 Drawing Sheets

Fig. 1
(Prior Art)
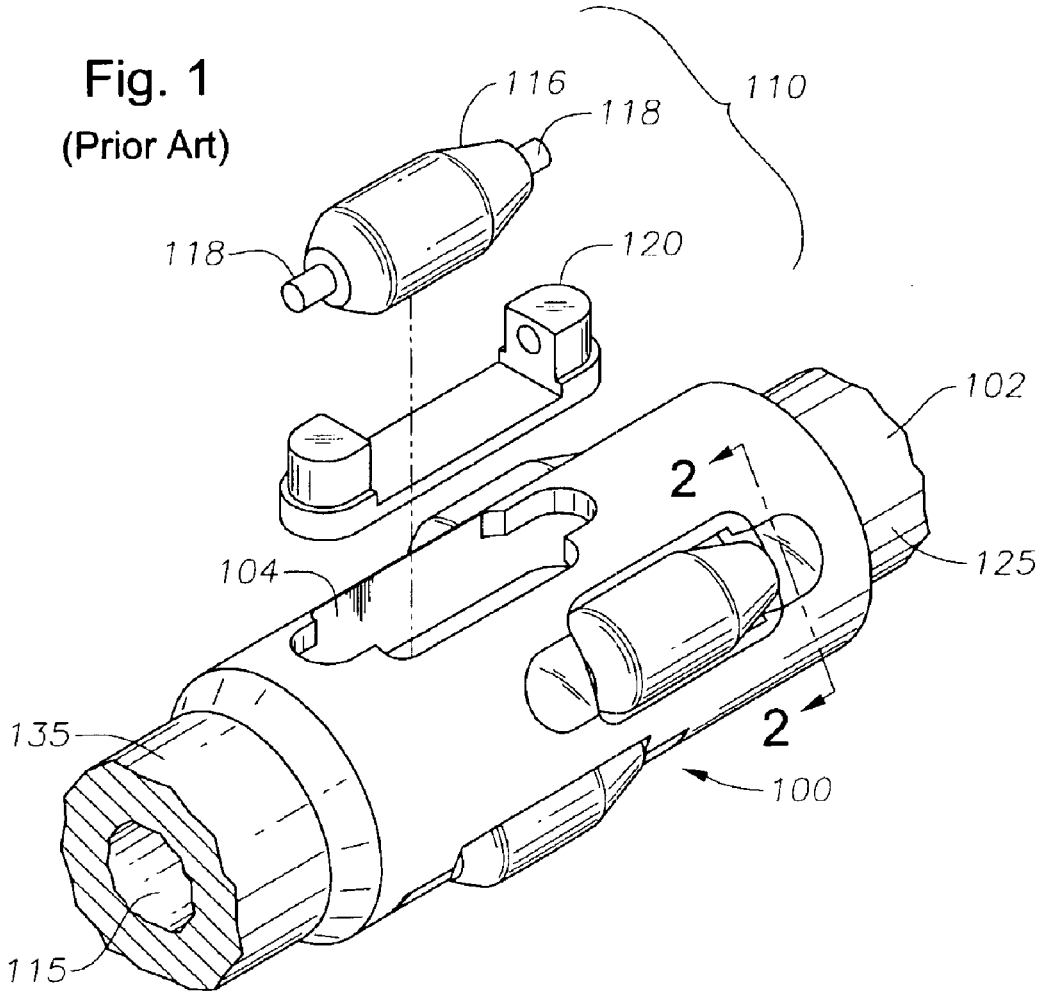
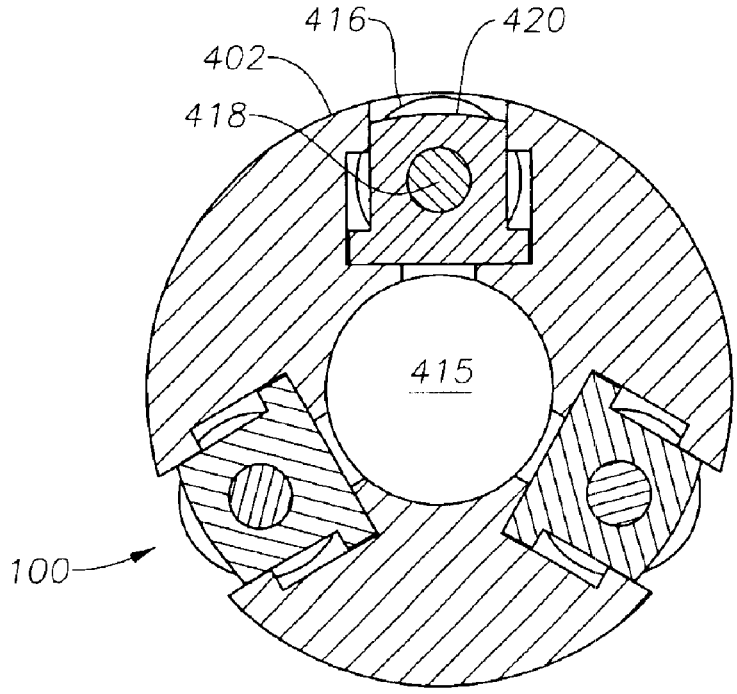
Fig. 2
(Prior Art)

EXPANSION ASSEMBLY FOR A TUBULAR EXPANDER TOOL, AND METHOD OF TUBULAR EXPANSION

BACKGROUND OF THE INVENTION

1. Field of the Invention

The present invention relates to wellbore completion. More particularly, the invention relates to an apparatus and method for expanding a tubular body. More particularly still, the apparatus relates to an expander tool for expanding a section of tubulars within a wellbore.

2. Description of the Related Art

Hydrocarbon and other wells are completed by forming a borehole in the earth and then lining the borehole with steel pipe or casing to form a wellbore. After a section of wellbore is formed by drilling, a string of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubular bodies to be expanded within a wellbore. The apparatus typically includes an expander tool that is run into the wellbore on a working string. The expander tool includes radially expandable members, or "expansion assemblies," which are urged radially outward from a body of the expander tool, either in response to mechanical forces, or in response to fluid injected into the working string. The expansion assemblies are expanded into contact with a surrounding tubular body. Outward force applied by the expansion assemblies cause the surrounding tubular to be expanded. Rotation of the expander tool, in turn, creates a radial expansion of the tubular.

Multiple uses for expandable tubulars are being discovered. For example, an intermediate string of casing can be hung off of a string of surface casing by expanding an upper portion of the intermediate casing string into frictional contact with the lower portion of surface casing therearound. Additionally, a sand screen can be expanded into contact with a surrounding formation in order to enlarge the inner diameter of the wellbore. Additional applications for the expansion of downhole tubulars exist.

FIG. 1 is an exploded view of an exemplary expander tool 100. FIG. 2 presents the same expander tool 100 in cross-section, with the view taken across line 2—2 of FIG. 1.

The expander tool 100 has a body 102 which is hollow and generally tubular. The central body 102 has a plurality of recesses 104 to hold a respective expansion assembly 110. Each of the recesses 104 has parallel sides and holds a respective piston 120. The pistons 120 are radially slidable, one piston 120 being slidably sealed within each recess 104. The back side of each piston 120 is exposed to the pressure of fluid within a hollow bore 115 of the expander tool 100. In this manner, pressurized fluid provided from the surface of the well can actuate the pistons 120 and cause them to extend outwardly.

Disposed within each piston 120 is a roller 116. In one embodiment of the expander tool 100, the rollers 116 are near cylindrical and slightly barreled. Each of the rollers 116 is supported by a shaft 118 at each end of the respective roller 116 for rotation about a respective axis. The rollers 116 are generally parallel to the longitudinal axis of the tool 100. In the arrangement of FIG. 1, the plurality of rollers 116 is radially offset at mutual 120-degree circumferential separations around the central body 102. In the arrangement shown in FIG. 1, two offset rows of rollers 116 are shown. However, only one row, or more than two rows of roller 116, may be incorporated into the body 102.

As sufficient pressure is generated on the piston surface behind the expansion assembly 110, the tubular being acted upon (not shown) by the expander tool 110 is expanded past its point of elastic deformation. In this manner, the inner and outer diameter of the tubular is increased within the wellbore. By rotating the expander tool 100 in the wellbore and/or moving the expander tool 100 axially in the wellbore with the expansion assemblies 110 actuated, a tubular can be expanded into plastic deformation along a predetermined length. Where the expander tool 100 is translated within the wellbore, the shaft 118 serves as a thrust bearing.

One disadvantage to known expander tools, such as the hydraulic tool 100 shown in FIGS. 1–2, is the inherently restricted size of the hollow bore 115. In this respect, the dimension of the bore 115 is limited by the size of the expansion assemblies 110 radially disposed around the body 102 of the tool 100. The constricted bore 115 size, in turn, imposes a limitation on the volume of fluid that can be injected through the working string at any given pressure. Further, the dimensions of the bore 115 in known expander tools place a limit on the types of other tools which can be dropped through the expander tool 100. Examples of such tools include balls, darts, retrieving instruments, fishing tools, bridge plugs and other common wellbore completion tools.

In addition, the tubulars being expanded within a wellbore generally define a thick-walled, high-strength steel body. To effectively expand such tubulars, a large cross-sectional geometry is required for the roller body 116. This further limits the inner bore diameter, thereby preventing adequate flow rates, and minimizing the space available to run equipment through the inner bore 115. Also, the stresses required to expand the material are very high; hence, reducing the roller body size to accommodate a larger inner bore diameter would mechanically weaken the roller mechanism, thereby compromising the functionality of the expansion assembly.

Therefore, a need exists for an expander tool which provides for a larger configuration for the hollow bore 115 therein. Further, a need exists for an expander tool which reduces the size of the expansion assemblies 110 around the tool 100 so as to allow for a greater bore 115 size without reducing the size of the roller body. Further, a need exists for an expander tool having expansion assemblies which do not rely upon rollers 116 rotating about a shaft 118 at a spaced apart distance from the piston member 120.

SUMMARY OF THE INVENTION

The present invention provides an apparatus for expanding a surrounding tubular body. More specifically, an improved expansion assembly for a radially rotated expander tool is disclosed. In addition, a method for expanding a tubular body, such as a string of casing within a hydrocarbon wellbore, is provided, which employs the improved expansion assembly of the present invention.

The expansion assembly first comprises a piston. The piston is preferably an elongated wafer-shaped body which is sealingly disposed within an appropriately configured recess of an expander tool. The piston has a top surface and a bottom surface. The top surface is configured to receive a roller body. In the expansion assembly of the present invention, the roller body does not rotate about a shaft; instead, the roller body serves as a "pad," and resides in close proximity to the top surface of the piston.

The pad is mounted onto the top surface of the piston. In one aspect, mounting is by brackets affixed to the top surface of the piston at opposite ends. The brackets receive connectors that connect the pad to the brackets. In this way, the pad resides intermediate the two opposite brackets.

The pad is configured to reside closely above the top piston. This reduces the overall size of the expansion assembly, allowing more room for the hollow bore within the expander tool. To this end, the pad has a substantially flat bottom surface that resides upon the top surface of the piston. The pad further has an arcuate upper surface. The arcuate upper surface contacts the surrounding tubular to be expanded during an expansion operation. To aid in the expansion process, the pad is preferably, tapered. This reduces the amount of force needed to expand the pad into the casing.

In the expansion assembly of the present invention, the pad is reinforced with at least one reinforcement member. The reinforcement member may be of any arrangement. In one embodiment, the reinforcement member comprises hardened inserts disposed on the pad in the area of contact between the pad and a surrounding tubular during an expansion operation. In another aspect, the reinforcement member defines a coating of a substance fabricated from a material capable of withstanding the high temperature and frictional forces at work during a downhole expansion operation.

In one arrangement, the bottom surface of the piston is exposed to fluid pressure within the bore of the expander tool. The piston is moved radially outward from the body of the expander tool but within the recess in response to fluid pressure or other outward force within the bore. Because the pad is held closely to the piston, greater space is accommodated for the bore within the expander tool.

BRIEF DESCRIPTION OF THE DRAWINGS

So that the manner in which the above recited features of the present invention are attained and can be understood in detail, a more particular description of the invention, briefly summarized above, may be had by reference to the appended drawings (FIGS. 3–10). It is to be noted, however, that the appended drawings illustrate only typical embodiments of this invention and are therefore not to be considered limiting of its scope, for the invention may admit to other equally effective embodiments.

FIG. 1 is an exploded view of an expander tool previously known as of the time of the filing of this continuation-in-part application. The roller is consistent with an embodiment described in the pending parent application. Visible in FIG. 1 is an expansion assembly having a roller which rotates about a shaft.

FIG. 2 is a cross-sectional view of the expander tool of FIG. 1, taken across line 2—2 of FIG. 1.

In FIG. 7A, a reinforcing bar is shown exploded away from the pad. In FIG. 7B, the reinforcing bar is being inserted into a channel within the pad. In FIG. 7C, the reinforcing bar is in place within the channel of the pad.

DETAILED DESCRIPTION OF THE PREFERRED EMBODIMENT

Figure 3:
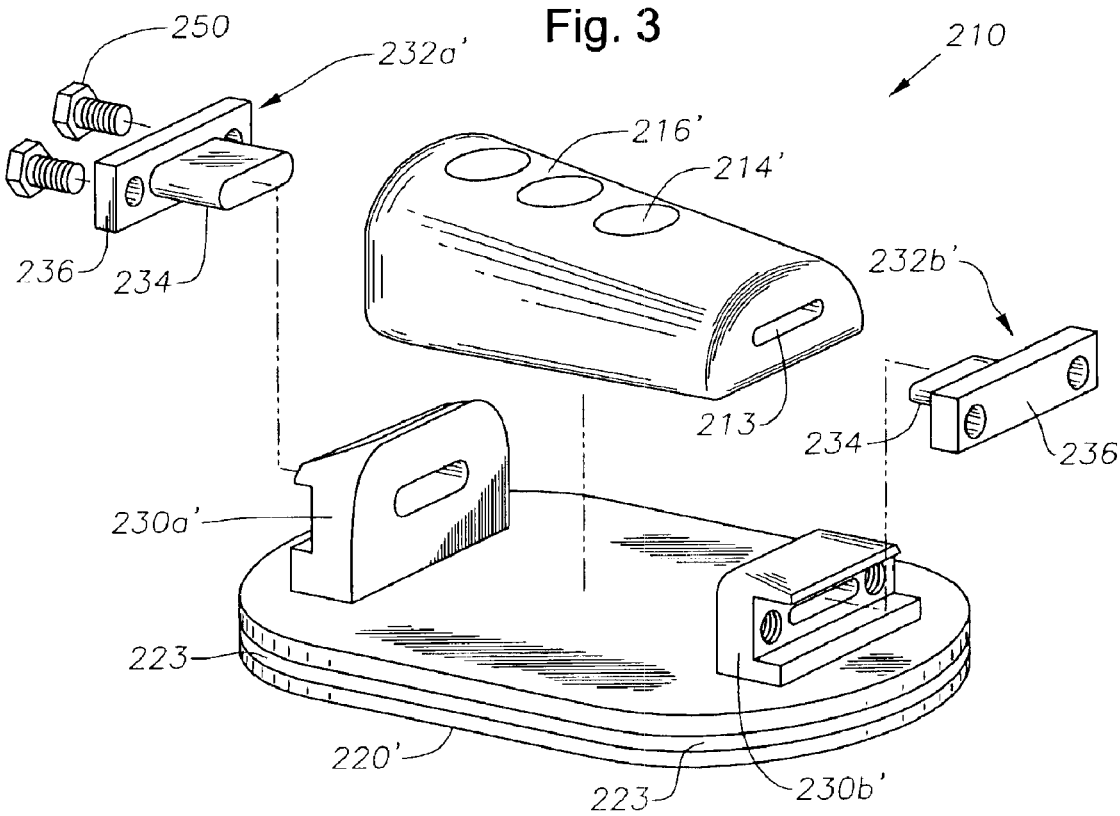
FIG. 3 is an exploded view of an expansion assembly of the present invention, in one embodiment. The expansion assembly is shown in perspective view. The expansion assembly is designed to operate within a body of an expander tool, such as a hydraulically actuated expander tool.

FIG. 3 presents a perspective view of an expansion assembly 210 of the present invention. The expansion assembly 210 is designed to be utilized within an expander tool (discussed later in connection with FIG. 9) for expanding a surrounding tubular body (not shown in FIG. 3). The parts of the expansion assembly 210 are presented in an exploded view for ease of reference.

The expansion assembly 210 first comprises a piston 220'. As will be discussed, the piston 220' resides within a recess of an expander tool 200. In the arrangement shown in FIG. 3, the piston 220' defines an elongated, wafer-shaped member capable of sliding outwardly from the expander tool 200 in response to hydraulic pressure within the bore 215 of the tool 200. A piston body recess 223 is circumferentially formed around the piston 220'. In one aspect, the recess 223 receives a seal (not shown). The recess 223 may also receive a shoulder (not shown) in the body 202 of an expander tool (shown at 200 in FIG. 9) in order to limit inward and outward travel of the piston 220'.

The piston 220' has a top surface and a bottom surface. The bottom surface is exposed to a radially outward force from within the bore 215 of the expander tool 200. In one aspect, the radially outward force is generated by hydraulic pressure. The top surface of the piston 220' is configured to receive a pad 216'. In the expansion assembly of the present invention, the pad 216' does not rotate about a shaft; instead, the pad 216' fixedly resides in close proximity to the top surface of the piston 220'. In the arrangement of FIG. 3, the pad 216' does not roll or skid along the top surface of the piston 220'.

The pad 216' is fabricated from a durable material capable of operating under the high temperatures and pressures prevailing in a wellbore environment. In one aspect, a hardened steel or other metal alloy is employed. Alternatively, a ceramic or other hardened composite material may be employed. In any arrangement, it is understood that some sacrifice of the material of the pad 216' may occur due to the very high stresses required to expand a surrounding metal tubular.

To limit the degree of sacrificial loss of the pad 216' during an expansion operation, the pad 216' includes one or more reinforcing members 214' along the pad surface. The reinforcing members 214' may be of any size, shape and number, so long as they are disposed within or along the pad 216' at the area of contact between the pad 216' and the surrounding tubular. Preferably, the reinforcing members 214' are in a fixed position within the pad body 216'. In the arrangement of FIG. 3, the reinforcing members 214' are cylindrical in shape, and are embedded within the pad 216'. The depth of the reinforcing members 214' within the pad 216' is more clearly seen in the cross-sectional view of FIG. 4.

The reinforcing members 214' are fabricated from a hardened material of sufficient strength to withstand the high hertzian stresses and frictional forces applied during an expansion operation. Such materials include, for example, ceramics and tungsten carbide. The material of the reinforcing members 214' is of a more durable nature than the material of the pad 216'. The upper surface of the reinforcing members 214' may optionally extend slightly above the surface of the pad 216'. Alternatively, the upper surface of the reinforcing members 214' may be recessed slightly below the surface of the pad 216'. But preferably, the upper surface of the reinforcing members 214' is flush with the surface of the pad 216' as shown best in the cross-sectional view of FIG. 4.

In another arrangement, the reinforcing member 214' simply defines a coating placed on the outer surface of the pad 216'. The coating 214' is placed on the pad 216' at the area of contact with the surrounding tubular. An exemplary material, again, is tungsten carbide, though any hardened ceramic or metallic substance may be employed.

The pad 216' is mounted onto the top surface of the piston 220'. Any mounting arrangement may be employed. In the embodiment shown in FIG. 3, a pair of brackets 230*a'*, 230*b'* is affixed to the top surface of the piston 220' at opposite ends of the piston 220'. The brackets 230*a'*, 230*b'* receive respective connectors 232*a'*, 232*b'* that connect the pad 216' to the brackets 230*a*, 230*b'*. In this way, the pad 216' resides intermediate the two opposite brackets 230*a'*, 230*b'*. A bolt 250 is provided to secure each connector 232*a'*, 232*b'* to its corresponding bracket 230*a'*, 230*b'*.

In the arrangement of FIG. 3, each connector 232*a'*, 232*b'* includes a plate 236' and a tongue 234. The tongue 234 defines an elongated, substantially flat member that extends into a recess 213 within the pad 216' at an end. The tongue 234 aids in stabilizing the pad 216' relative to the piston 220'. The tongue 234 and the recess 213 are best seen in the exploded view of FIG. 3. In this view, it can be seen that the tongue 234 does not serve as a rotational axle. This means that the pad 216' in the expansion assembly 210' does not significantly rotate relative to the piston 220'. Removal of the shaft 118 from the previous embodiment of an expansion assembly 110 (FIG. 1) and the rotational function allows the overall diameter of the body 202 of the new expander tool 200 (shown in FIG. 9), to be increased, thereby saving valuable space within the bore 215 of the expander tool 200.

In the arrangement shown in FIG. 3, the pad 216' and the connectors 232*a'*, 232*b'* are separate pieces. However, it is understood that these items 216', 232*a'*, 232*b'* may be unitary in construction. Indeed, the piston 220', the pad 216', the connectors 232*a'*, 232*b'*, and the brackets 230*a'*, 230*b'* may be a solid, integral unit.

To further aid in the space-saving function of the expansion assembly 210', the pad 216' is disposed immediately upon the top surface of the piston 220. This further strengthens the pad 216' during the expansion procedure.

The configuration of the roller 116 shown in the prior art drawing of FIG. 1 is somewhat barrel-shaped. It also has a cross-sectional shape that is generally cylindrical. Such a configuration may be used in the pad 216 for the improved expansion assembly 210 of the present invention. Of course, it is to be appreciated that other roller shapes may be used, including semi-spherical, multifaceted, elliptical or any other cross sectional shape suited to the expansion operation to be conducted within a tubular. However, to further aid in the space-saving function of the expansion assembly 210, a tapered eccentric, e.g., non-circular pad 216' shape is provided.

Figure 4:
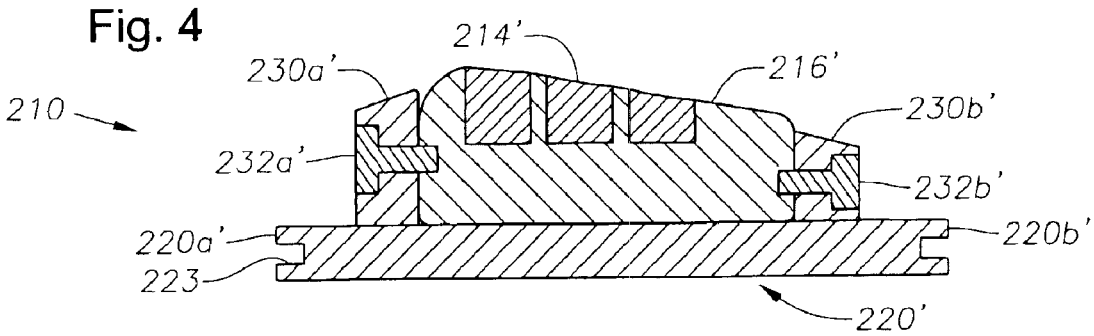
FIG. 4 is a side, cross-sectional view of the expansion assembly of FIG. 3.

The configuration of the novel pad 216' is best seen in the side cross-sectional view of FIG. 4. The surface of the pad 216' proximate to the piston 220' is essentially flat, permitting the pad 216' to reside in close proximity to (including immediately upon) the piston surface 220. In contrast, the portion of the pad 216' that contacts the surrounding tubular body, e.g., casing, is arcuate. In one aspect, the arcuate surface of the pad 216' is also tapered in diameter, and is non-circular in cross-section. The tapered shape allows the expander tool 200 to both rotate and translate within the wellbore simultaneously. In this respect, the expander tool 200 is urged within the wellbore in the direction of the pad 216' end having the reduced diameter.

In one aspect, the orientation of the tapered pad 216' is skewed relative to the longitudinal center axis of the bore of the expander tool 200. To accomplish this, the recess 204 in the expander tool body 202 is tilted so that the longitudinal axis of the pad 216' is out of parallel with the longitudinal axis of the tool 200. Preferably, the angle of skew is only approximately 1.5 degrees. It is perceived that skewing the orientation of the pad 216' may allow the expander tool 200 to be simultaneously rotated and translated against the surrounding casing more efficiently, i.e., reducing the thrust load required to push the roller into the casing during translation.

It is understood that "skewing" of the roller 216' is an optional feature. Further, the degree of tilt of the roller 216' is a matter of designer's discretion. In any event, the angle of tilt is preferably away from the direction of rotation of the tool 200 so as to enable the tool 200 to more freely be translated within the wellbore.

Figure 5:
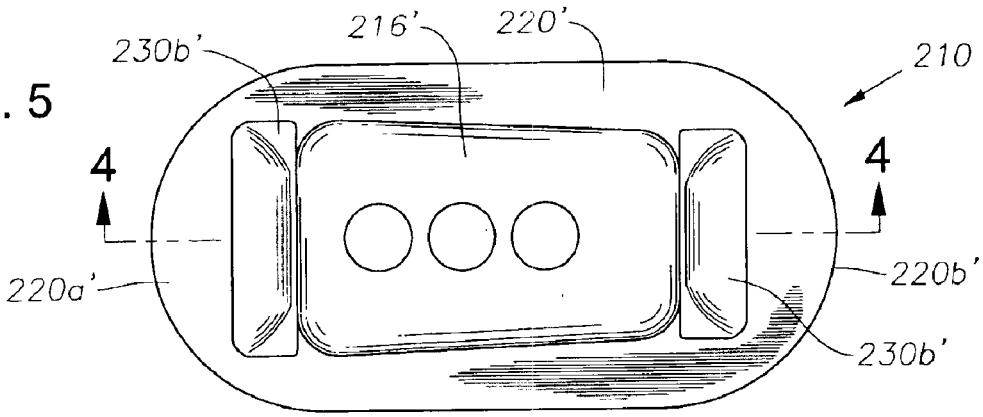
FIG. 5 is a top view of the expansion assembly of FIG. 3.

FIG. 5 presents a top view of the expansion assembly of FIG. 3. In this view, the configuration of the pad 216', and the disposition of the pad 216' upon the top surface of the piston 220 can be more fully seen. The preferred tapered configuration of the roller 216' is more fully demonstrated.

Figure 6:
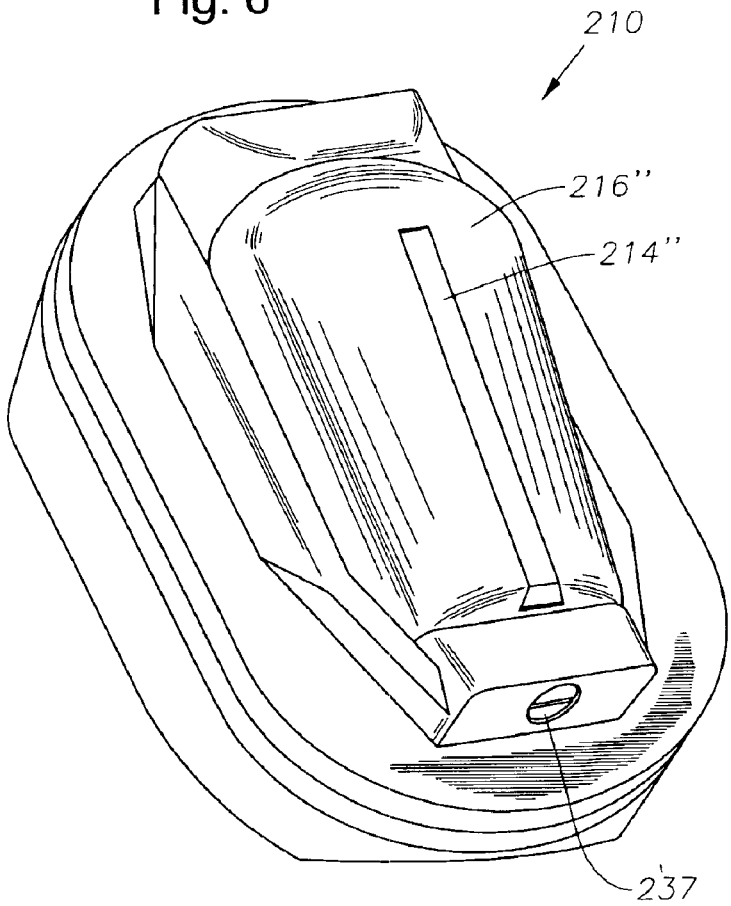
FIG. 6 presents a perspective view of an alternate embodiment for an expansion assembly. In this arrangement, an elongated reinforcing bar is disposed in the expansion assembly.
Figure 7A:
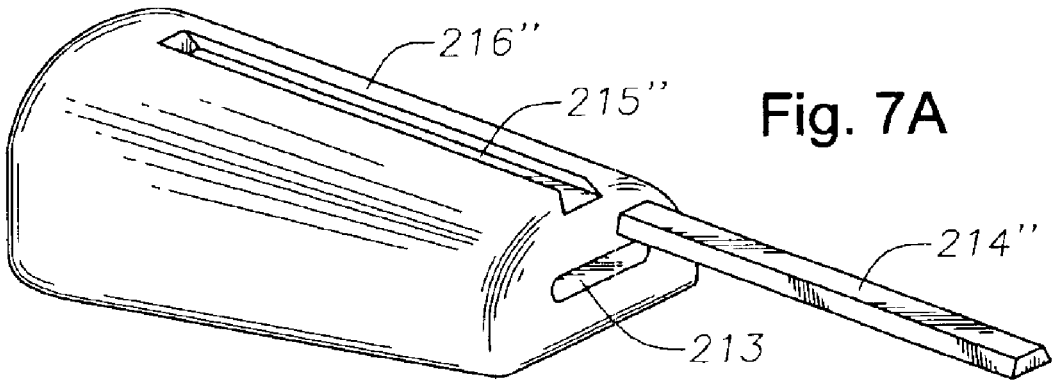
FIGS. 7A–7C present an exploded view of the pad of FIG. 7.
Figure 7B:
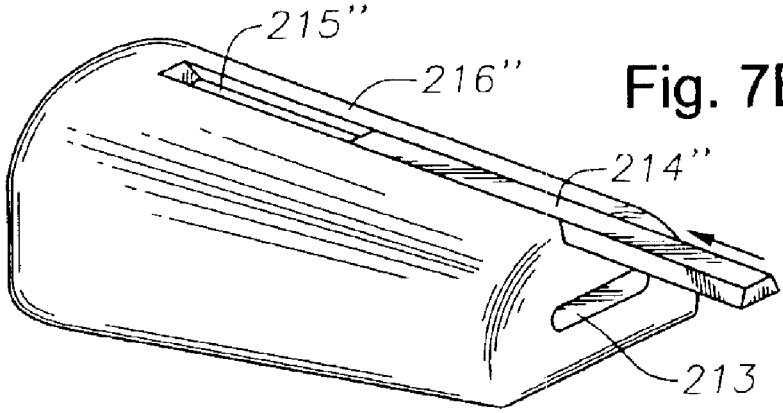
Figure 7C:
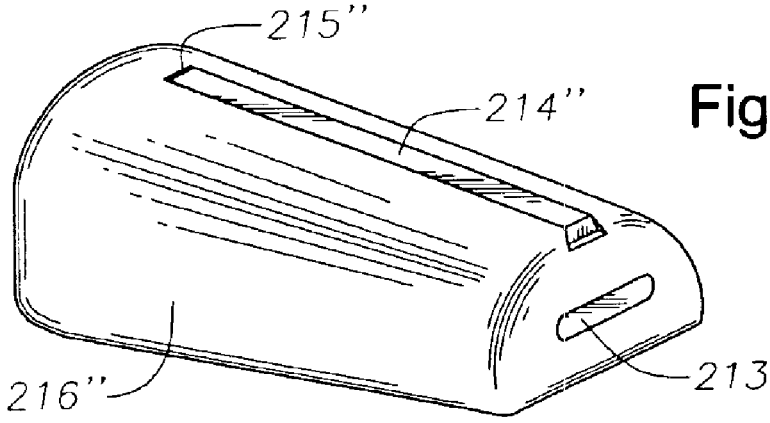

Other arrangements for an expansion assembly 210 exist. FIG. 6 presents a perspective view of such an alternate arrangement. In this view, the reinforcing member 214" defines an elongated bar. FIGS. 7A through 7C present perspective views of an alternate pad 216" using the single reinforcing bar 214". In FIG. 7A, the bar 214" is shown exploded away from the pad 216". In FIG. 7B, the reinforcing bar 214" is being inserted into a channel 215" within the pad 216". The channel 215" has a dove-tail cross-section for securely holding the reinforcing bar 214" within the pad 216". The bar 214" has a corresponding dove-tail cross-section for being received within the channel 215". In FIG. 7C, the reinforcing bar 214" is in place within the channel 215" of the pad 216".

Figure 8A:
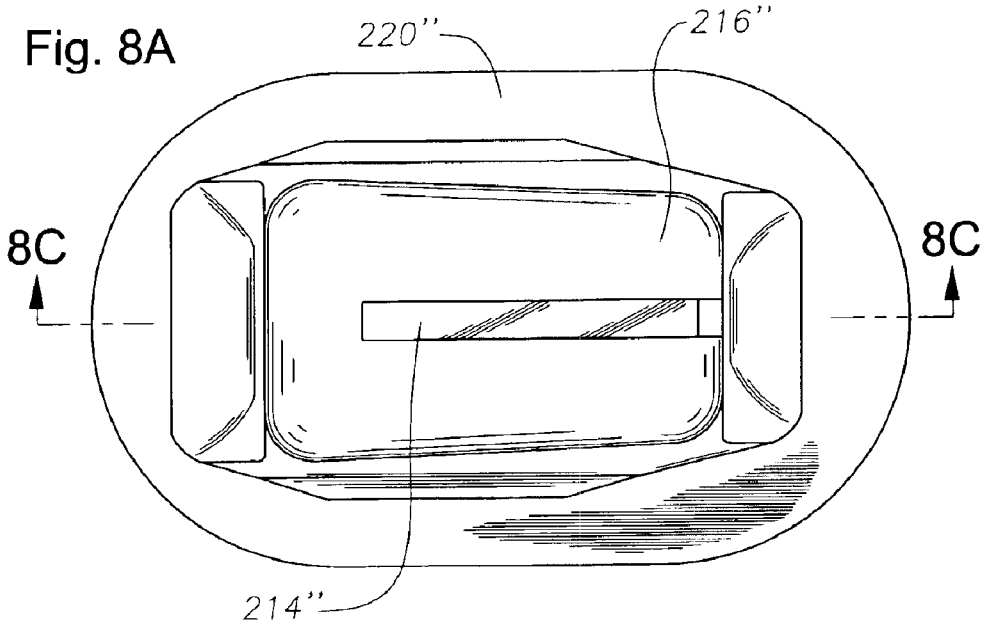
FIG. 8A presents the expansion assembly of FIG. 6 in a top view, while FIG. 8B provides an end view.
Figure 8B:
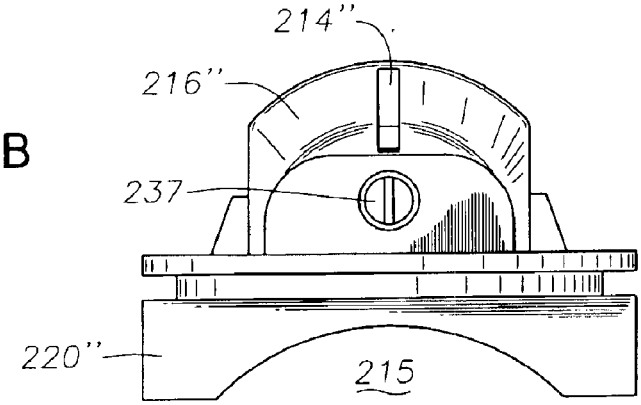
FIG. 8C is a cross-sectional view of the same expansion assembly, taken across the longitudinal axis.
Figure 8C:
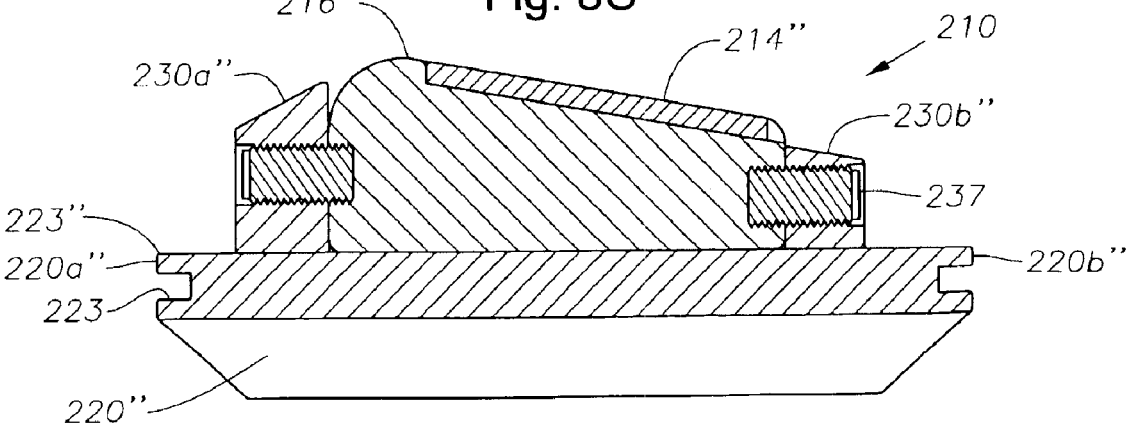

FIG. 8A presents the expansion assembly of FIG. 6 in a top view, while FIG. 8B provides an end view. FIG. 8C is a cross-sectional view of the same expansion assembly 210. In these views, it can be seen that a new mounting arrangement is provided for securing the pad 216" to the piston 220". Connector brackets 230*a*", 230*b*" are seen extending upward from the top piston 220" surface at either end 220*a*", 220*b*" of the pad 216". In this arrangement, a threaded connector 237 is placed through the connector brackets 230*a*", 230*b*" and into the pad 216" at either end. In this manner, the pad 216" is held in place in close proximity to the top piston 220" surface. For purposes of this disclosure, the phrase "in close proximity to" includes the pad 216" lying immediately upon the top piston 220" surface.

Figure 9:
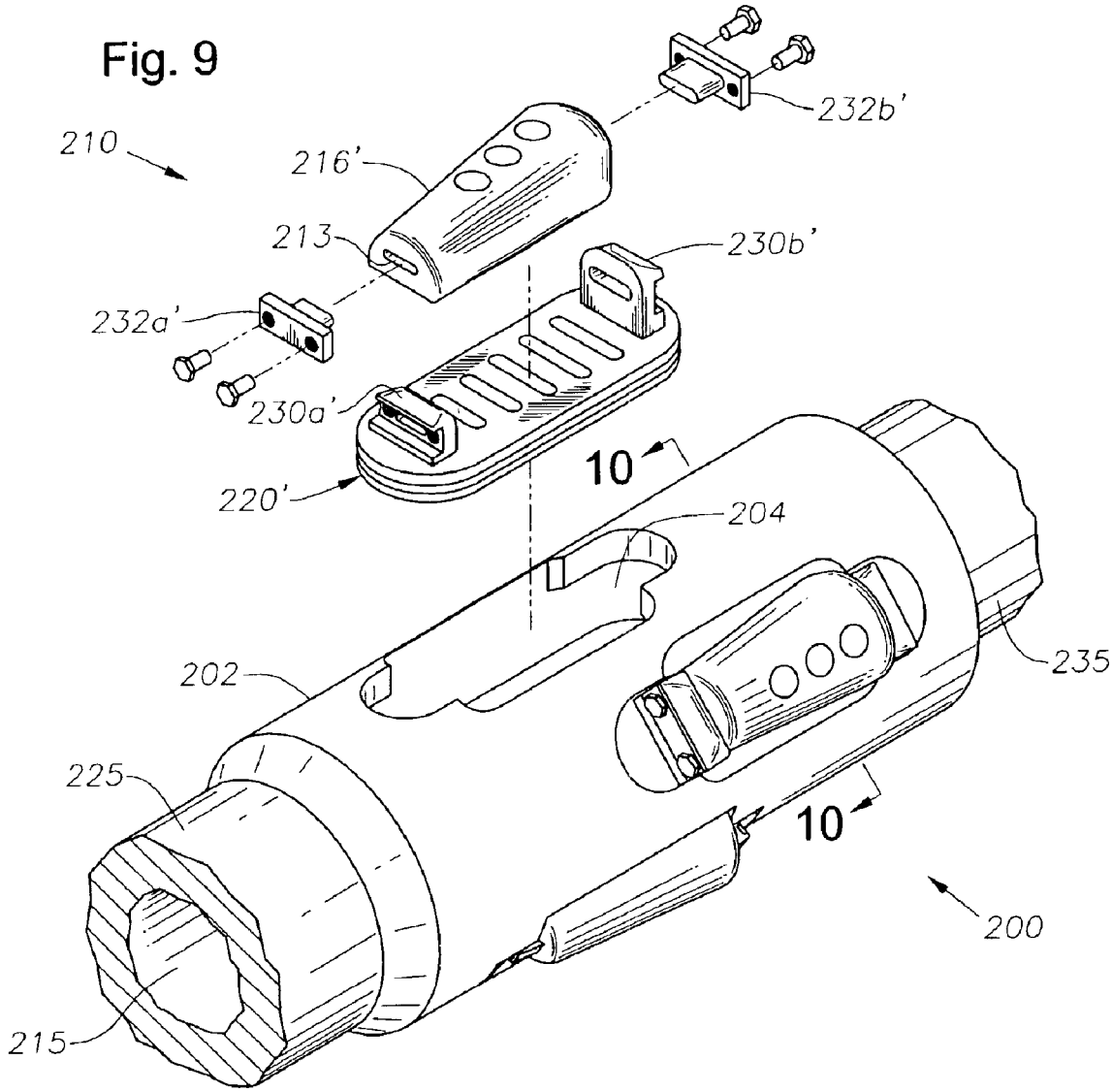
FIG. 9 is an exploded view of an expander tool which includes expansion assemblies of the present invention.

Referring now to FIG. 9, FIG. 9 presents a perspective view of an expander tool 200 as might be used with an expansion assembly 210. In this figure, the embodiment 210 of FIG. 3 is demonstrated. The view in FIG. 9 shows the piston 220', pad 216', mounting brackets 230*a*', 230*b*' and connectors 232*a*', 232B' in exploded arrangement above a recess 204. A plurality of recesses 204 is fabricated into the body 202 of the expander tool 200.

The body 202 of the expander tool 200 defines a tubular body. A bore 215 is seen running through the body 202. It is to be observed that the diameter of the bore 215 of the improved expander tool 200 is larger than the diameter of the bore 115 of the previously known expander tool 100, shown in FIG. 1.

Tubular connector members 225, 235 are shown disposed at either end of the expander tool 200. An upper connector 225 is typically connected to a working string, as will be shown in a later figure. A lower connector 235 may be used for connecting the expander tool 200 to other tools further downhole. Alternatively, connector 235 may simply define a deadhead.

Figure 10:
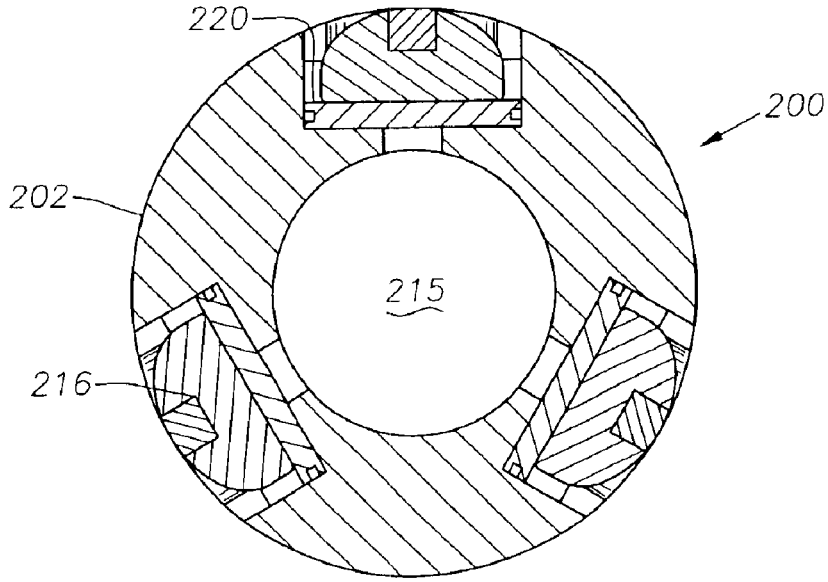
FIG. 10 is a cross-sectional view of the expander tool of FIG. 9, taken across line 10—10 of FIG. 9.

FIG. 10 presents a cross-sectional view of the expander tool 200 of FIG. 9. The view is taken across line 10—10 of FIG. 9. More visible in this view is the enlarged dimension of the bore 215 permitted by the novel expansion assembly 210 of the present invention.

Figure 11:
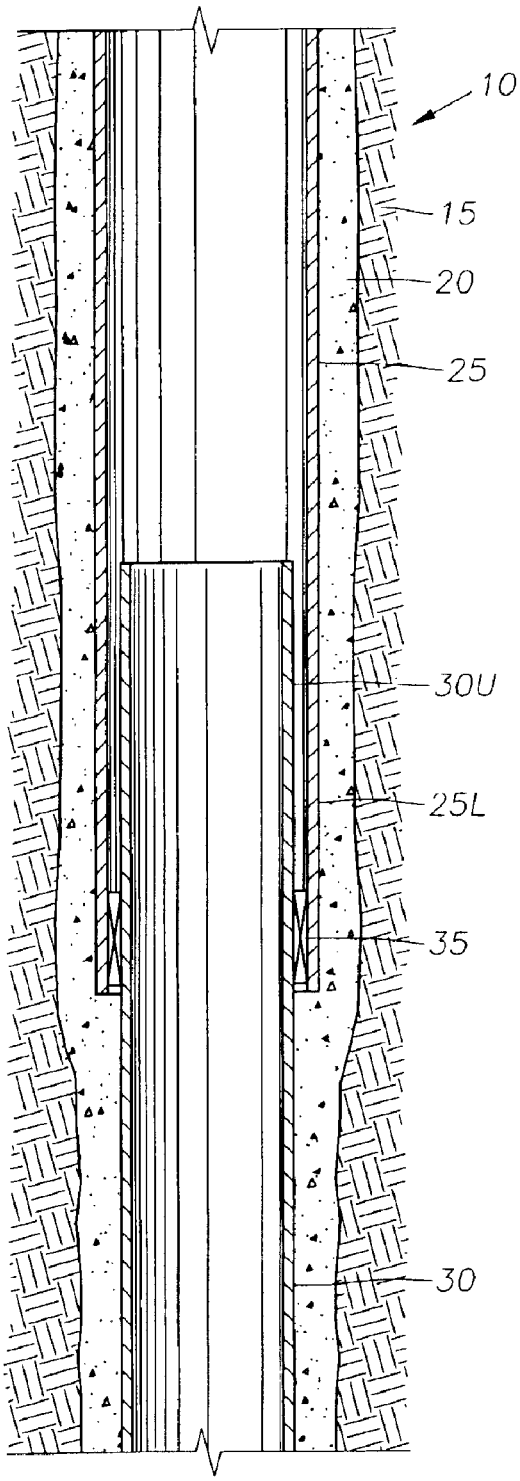
FIG. 11 is a cross-sectional view of a wellbore. The wellbore includes an upper string of casing, and a lower string of casing having been hung off of the upper string of casing. In this view, the lower string of casing serves as a tubular body to be expanded.

In order to demonstrate the operation of the expander tool 200, FIGS. 11–14 have been provided. FIG. 11 provides a cross-sectional view of the wellbore 10. The wellbore 10 is cased with an upper string of casing 25. The upper string of casing 25 has been cemented into a surrounding formation 15 by a slurry of cement 20. The wellbore 10 also includes a lower string of casing 30, sometimes referred to as a "liner." The lower string of casing 30 has an upper portion 30U which has been positioned in the wellbore 10 at such a depth as to overlap with a lower portion 25L of the upper string of casing 25. It can be seen that the lower string of casing 30 is also cemented into the wellbore 10. A packer 35 is shown schematically in FIG. 11, providing support for the lower string of casing 30 within the upper string of casing 25 before the cement 20 behind the lower sting of casing 25 is cured.

Figure 12:
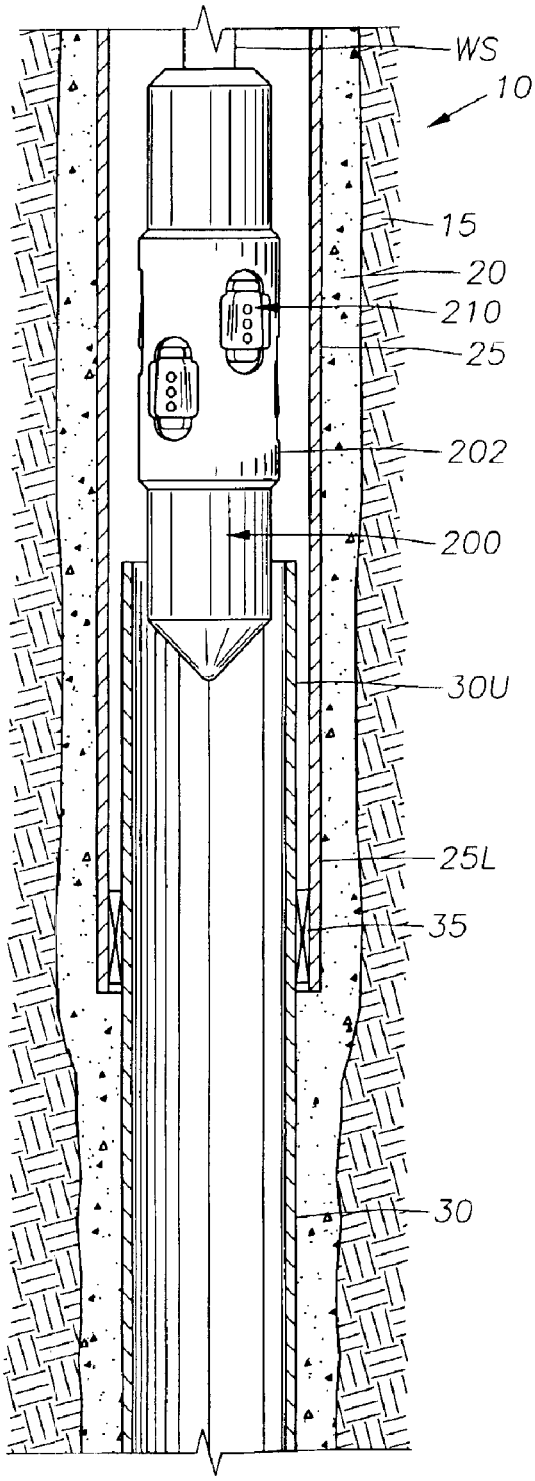
FIG. 12 presents the wellbore of FIG. 11. In the view, an expander tool which includes expansion assemblies of the present invention is being lowered into the wellbore on a working string.

FIG. 12 presents the wellbore of FIG. 11, with a working string WS being lowered into the wellbore 10. Affixed at the bottom of the working string WS is an expander tool 200. The expander tool 200 includes improved expansion assemblies 210 of the present invention. In this view, the expansion assemblies 210 have not yet been actuated.

Figure 13:
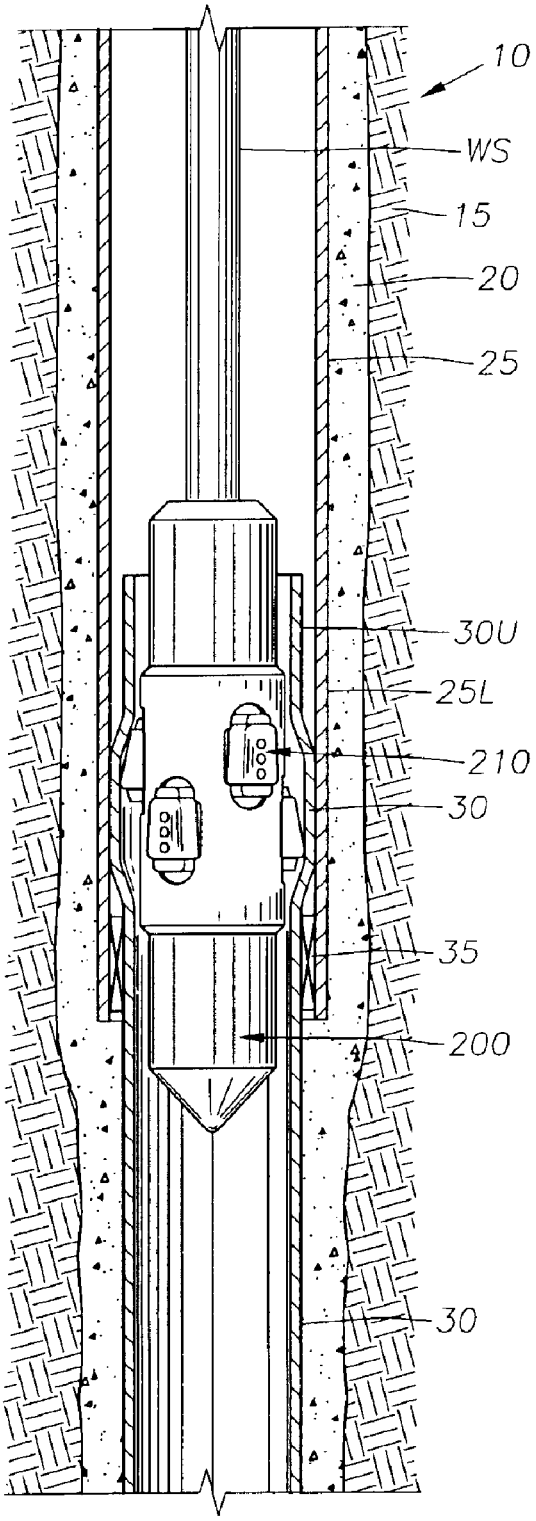
FIG. 13 presents the wellbore of FIG. 12, with the expander tool being actuated in order to expand the lower string of casing into the upper string of casing, thereby further hanging the liner from the upper string of casing.

Turning now to FIG. 13, the expander tool 200 has been lowered to a depth within the wellbore 10 adjacent the overlapping strings of casing 25L, 30U. The expansion assemblies 210 of the expander tool 200 have been actuated. In this manner, the upper portion 30U of the lower string of casing 30 can be expanded into frictional engagement with the surrounding lower portion 25L of the upper string of casing 20.

In order to actuate the expander tool 200, fluid is injected into the working string WS. Fluid under pressure then travels downhole through the working string WS and into the perforated tubular bore 215 of the tool 200. From there, fluid contacts the bottom surfaces of the pistons (shown in FIGS. 3 and 6 as 220' and 220", respectively). As hydraulic pressure is increased, fluid forces the pistons outwardly from their respective recesses 204. This, in turn, causes the rollers (shown in FIGS. 3 and 6 as 216' and 216", respectively) to make contact with the inner surface of the liner 30L. With a predetermined amount of fluid pressure acting on the piston surface 220, the lower string of expandable liner 30L is expanded past its elastic limits. Fluid exits the expander tool 200 through the bottom connector 235 at the base of the tool 200.

It will be understood by those of ordinary skill in the art that the working string WS shown in FIGS. 12 and 13 is highly schematic. It is understood that numerous other tools may and commonly are employed in connection with a well completion operation. For example, the lower string of casing 30 would typically be run into the wellbore 10 on the working string WS itself. Other tools would be included on the working string WS and the liner 30, including a cement shoe (not shown) and a wiper plug (also not shown). Numerous other tools to aid in the cementing and expansion operation may also be employed, such as a swivel (not shown) and a collet or dog assembly (not shown) for connecting the working string WS with the liner 30. Further, the packer 35 would more typically be a liner hanger disposed at the upper end 30U of the lower string of casing 30.

Figure 14:
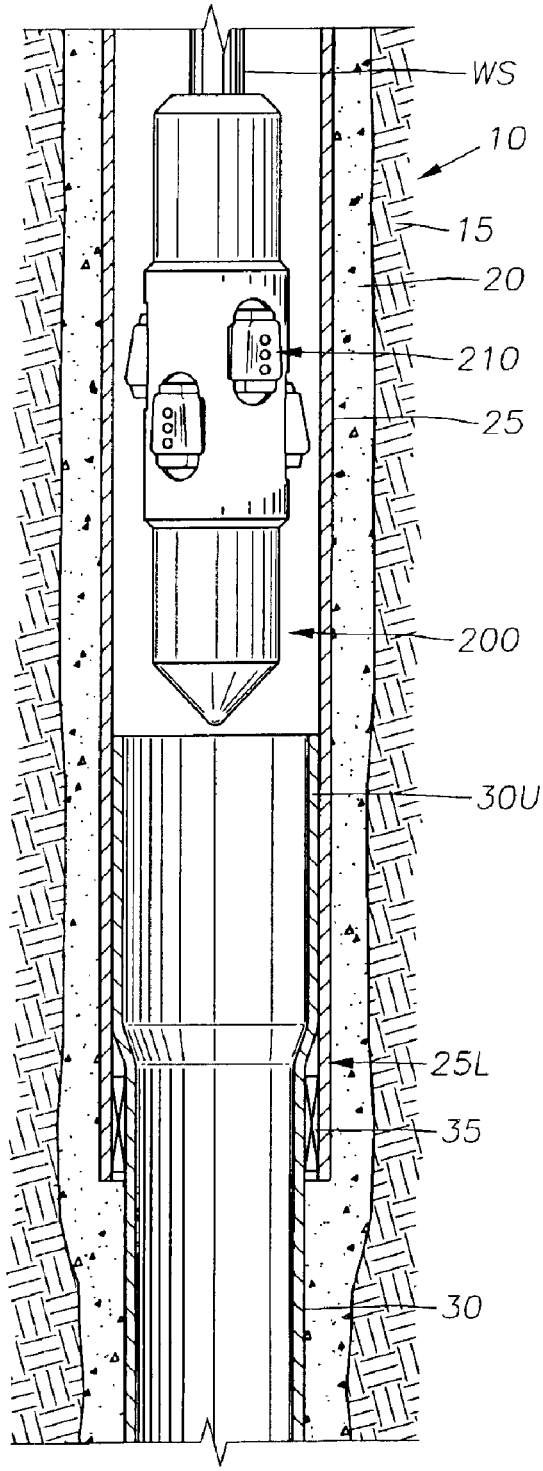
FIG. 14 presents the wellbore of FIG. 13, in which the lower string of casing has been expanded into the upper string of casing along a desired length. The expander tool has been removed from the wellbore.

FIG. 14 presents the lower string of casing 30 having been expanded into frictional engagement with the surrounding upper string of casing 25 along a desired length. In this view, the upper portion 30U of the lower string of casing 30 has utility as a polished bore receptacle. Alternatively, a separate polished bore receptacle can be landed into the upper portion 30U of the lower string of casing 30 with greater sealing capability. Further, a larger diameter of tubing (not shown) may be landed into the liner 30 due to the expanded upper portion 30U of the liner 30. It is understood that the depictions in FIGS. 12, 13, and 14 are simply to demonstrate one of numerous uses for an expander tool 200, and to demonstrate the operation of the expansion assembly 210.

As demonstrated, an improved expansion assembly 210 for an expander tool 200 has been provided. In this respect, the rollers 216 of the expansion apparatus 210 are able to reside in close proximity to the surface of a piston 220. In this way, the shaft of previous embodiments of an expander tool has been removed, and a bearing system has been provided in its place. The entire bearing system can be angled to allow the expansion assembly 210 to be rotated and axially translated simultaneously with lower forces applied against the pad 216. In one aspect, no shaft or thrust bearing apparatus is needed. In another aspect, a non-circular (eccentric) pad 216 is employed, with the pad 216 residing immediately upon the surface of the piston 220. With these features, the expansion assembly components 210 are geometrically reduced, thereby affording a larger inner diameter for the bore 215 of the expander tool 200.

The above description is provided in the context of a hydraulic expander tool. However, it is understood that the present invention includes expander tools in which the pistons are moveable in response to other radially outward forces, such as mechanical forces. While the foregoing is directed to embodiments of the present invention, other and further embodiments of the invention may be devised without departing from the basic scope thereof, and the scope thereof is determined by the claims that follow.

What is claimed is:

1. An expansion assembly for an expander tool for expanding a surrounding tubular body, the expansion assembly being disposed within a recess in the body of the expander tool, the expansion assembly comprising:

a piston disposed within the recess of the expander tool, the piston having a bottom surface and a top surface, the bottom surface being exposed to a radially outward force within the bore of the expander tool, and the piston being outwardly extendable from the body of the expander tool within the recess in response to the radially outward force;

a pad residing in close proximity to the top surface of the piston; and at least one reinforcement member fabricated into the pad in the area of contact between the pad and the surrounding tubular during an expansion operation.

2. The expansion assembly of claim 1, wherein the wherein the position of the at least one reinforcement member is fixed within the pad.

3. The expansion assembly of claim 2, wherein the wherein the at least one reinforcement member defines a plurality of hardened inserts.

4. The expansion assembly of claim 3, wherein the wherein the plurality of hardened inserts are fabricated from tungsten carbide.

5. The expansion assembly of claim 1, wherein the reinforcement member defines a coating placed upon the pad in the area of contact between the pad and the surrounding tubular body during an expansion operation.

6. The expansion assembly of claim 5, wherein the coating is fabricated from tungsten carbide.

7. The expansion assembly of claim 1, further comprising a mounting arrangement for supporting the pad above the top surface of the piston.

8. The expansion assembly of claim 7, wherein the mounting arrangement comprises:

a first bracket at the top surface of the piston for supporting the pad at a first end; and a second bracket at the top surface of the piston for supporting the pad at a second opposite end.

9. The expansion assembly of claim 8, wherein the pad is substantially rotationally fixed relative to the top surface of the piston.

10. The expansion assembly of claim 9, wherein each of the first and second brackets receives a connector for connecting the first and second brackets to the respective first and second opposite ends of the pad.

11. The expansion assembly of claim 10, wherein the connector comprises:

a plate secured to the bracket; and a tongue extending from the bracket and received within the pad at an end.

12. The expansion assembly of claim 10, wherein the connector comprises a threaded connector member.

13. The expansion assembly of claim 1, wherein the pad comprises:

a first substantially flat surface residing upon the top surface of the piston; and a second arcuate surface above the first substantially flat surface.

14. The expansion assembly of claim 13, wherein the second arcuate surface of the pad is non-circular.

15. The expansion assembly of claim 14, wherein the position of the at least one reinforcement member is fixed within the pad.

16. The expansion assembly of claim 15, wherein the wherein the at least one reinforcement member defines a plurality of hardened inserts.

17. The expansion assembly of claim 16, wherein the wherein the plurality of hardened inserts are fabricated from tungsten carbide.

18. The expansion assembly of claim 13, wherein the reinforcement. member defines a coating placed upon the pad in the area of contact between the pad and the surrounding tubular body during an expansion operation.

19. The expansion assembly of claim 1, wherein the radially outward forces are hydraulic forces from within the bore of the expander tool.

20. The expansion assembly of claim 19, wherein the piston sealingly resides within the recess of the body of the expander.

21. The expansion assembly of claim 1, wherein the orientation of the pad is skewed relative to the longitudinal center axis of the bore of the expander tool.

22. The expansion assembly of claim 7, wherein the mounting arrangement and the pad are of a unitary construction.

23. The expansion assembly of claim 7, wherein the piston and the pad are of a unitary construction.

24. The expansion assembly of claim 22, wherein the mounting arrangement comprises:

a first bracket affixed to the top surface of the piston for supporting the pad at a first end; and a second bracket affixed to the top surface of the piston for supporting the pad at a second opposite end.

25. The expansion assembly of claim 24, wherein each of the first and second brackets receives a connector for connecting the first and second brackets to the respective first and second opposite ends of the pad.

26. An expansion assembly for a hydraulic expander tool for expanding a surrounding tubular body, the expansion assembly being sealingly disposed within a recess in the body of the expander tool, and the expander tool having a bore therethrough, the expansion assembly comprising:

a piston residing within the recess of the expander tool, and being outwardly extendable from the body of the expander tool within the recess in response to hydraulic pressure within the bore of the expander tool, the piston comprising a bottom surface exposed to fluid pressure within the expander tool, and a top surface;

a pad residing in close proximity to the top surface of the piston, the pad having a tapered outer surface;

at least one fixed reinforcement member fabricated into the pad in the area of contact between the pad and the surrounding tubular body during an expansion operation; and a mounting arrangement for supporting the pad upon the top surface of the piston such that the pad is substantially rotationally fixed relative to the top surface of the piston.

27. The expansion assembly of claim 26, wherein the wherein the position of the at least one reinforcement member is fixed within the pad.

28. The expansion assembly of claim 27, wherein the wherein the at least one reinforcement member defines a plurality of hardened inserts.

29. The expansion assembly of claim 28, wherein the wherein the plurality of hardened inserts are fabricated from tungsten carbide.

30. The expansion assembly of claim 26, wherein the reinforcement member defines a coating placed upon the pad in the area of contact between the pad and the surrounding tubular body during an expansion operation.

31. The expansion assembly of claim 30, wherein the coating is fabricated from tungsten carbide.

32. The expansion assembly of claim 26, wherein the mounting arrangement and the pad are of a unitary construction.

33. The expansion assembly of claim 26, wherein the piston and the pad are of a unitary construction.

34. The expansion assembly of claim 26, wherein the orientation of the pad is skewed relative to the longitudinal center axis of the bore of the expander tool.

35. A method for expanding a tubular body within a hydrocarbon wellbore, comprising the steps of:

attaching an expander tool to the lower end of a working string, the expander tool having a body and a plurality of recesses within the body, each recess receiving an expansion assembly, each expansion assembly comprising:

a piston disposed within the recess of the expander tool, the piston having a bottom surface and a top surface, the bottom surface being exposed to a radially outward force within the bore of the expander tool, and the piston being outwardly extendable from the body of the expander tool within the recess in response to the radially outward force;

a pad residing in close proximity to the top surface of the piston, the pad having a tapered outer surface;

at least one fixed reinforcement member fabricated into the pad in the area of contact between the pad and the surrounding tubular during an expansion operation; and a mounting arrangement for supporting the pad upon the top surface of the piston such that the pad is substantially rotationally fixed. relative to the top surface of the piston;

running the working string with the expander tool into a wellbore; and rotating the working string in order to radially expand a section of the surrounding tubular body within the wellbore.

36. The method for expanding a tubular body within a wellbore of claim 35, wherein the pad defines a tapered body.

37. The method for expanding a tubular body within a wellbore of claim 36, wherein the pad comprises:

a first substantially flat surface residing upon the top surface of the piston; and a second arcuate surface above the first substantially flat surface.

38. The method for expanding a tubular body within a wellbore of claim 37, wherein the second arcuate surface of the pad is non-circular.

39. The method for expanding a tubular body within a wellbore of claim 35, wherein the mounting arrangement comprises:

a first bracket affixed to the top surface of the piston for supporting the pad at a first end; and a second bracket affixed to the top surface of the piston for supporting the pad at a second opposite end.

40. The method for expanding a tubular body within a wellbore of claim 39, wherein each of the first and second brackets receives a connector for connecting the first and second brackets to the respective first and second opposite ends of the pad.

41. The method for expanding a tubular body within a wellbore of claim 40, wherein the connector comprises:

a plate secured to the bracket; and a tongue extending from the bracket and received within the pad at an end.

42. The method for expanding a tubular body within a wellbore of claim 40, wherein the connector comprises a threaded member.

43. The method for expanding a tubular body within a wellbore of claim 35, wherein the radially outward forces are hydraulic forces from within the bore of the expander tool.

44. An expansion assembly for an expander tool for expanding a surrounding tubular body, the expansion assembly being disposed within a recess in the body of the expander tool, the expansion assembly comprising:

a piston disposed within the recess of the expander tool, the piston having a bottom surface and a top surface, the bottom surface being exposed to a radially outward force within the bore of the expander tool, and the piston being outwardly extendable from the body of the expander tool within the recess in response to the radially outward force;

a pad residing in close proximity to the top surface of the piston; and at least one wear resistance means fabricated into the pad in the area of contact between the pad and the surrounding tubular during an expansion operation.

* * * * *

UNITED STATES PATENT AND TRADEMARK OFFICE

CERTIFICATE OF CORRECTION

PATENT NO. : 6,843,319 B2
DATED : January 18, 2005
INVENTOR(S) : Tran

It is certified that error appears in the above-identified patent and that said Letters Patent is hereby corrected as shown below:

Column 9,
Lines 53 and 56, please remove “wherein the”.

Column 10,
Lines 32 and 35, please remove “wherein the”.
Line 39, please remove “reinforcement.” and replace with -- reinforcement --.

Column 11,
Lines 19, 22 and 25, please remove “wherein the”.
Line 63, please remove “fixed.” and replace with -- fixed --.

Signed and Sealed this

Twenty-first Day of June, 2005

JON W. DUDAS
*Director of the United States Patent and Trademark Office*